United States Patent [19]

Lotz

[11] 4,130,080

[45] Dec. 19, 1978

[54] INDICATING CONTROL STRUCTURE

[75] Inventor: Lawrence C. Lotz, Marion, Ohio

[73] Assignee: Whirlpool Corporation, Benton Harbor, Mich.

[21] Appl. No.: 801,835

[22] Filed: May 31, 1977

[51] Int. Cl.[2] ..... G09F 9/40; H01C 10/32

[52] U.S. Cl. ..... 116/2; 116/129 R; 116/135; 338/162

[58] Field of Search ..... 116/129 R, 129 T, 129 AB, 116/129 F, 129 E, 129 H, 129 T, 135, 2, DIG. 37; 200/16 D; 338/159, 162, 172, 160

[56] References Cited

U.S. PATENT DOCUMENTS

| | | | |
|---|---|---|---|
| 1,559,427 | 10/1925 | Hemphill | 338/198 X |
| 2,619,933 | 12/1952 | Gordon, Jr. et al. | 116/129 R |
| 2,782,403 | 2/1957 | Pierce | 340/252 H |
| 3,070,062 | 12/1962 | Ohlheiser | 116/133 X |
| 3,455,273 | 7/1969 | Willingham, Jr. | 116/133 |
| 3,499,127 | 3/1970 | Cherry et al. | 200/17 R |
| 3,639,706 | 2/1972 | Purdy | 200/17 R |
| 3,970,985 | 7/1976 | Sage | 338/162 |
| 4,042,903 | 8/1977 | Finegan, Jr. | 338/159 |

*Primary Examiner*—Daniel M. Yasich

*Attorney, Agent, or Firm*—Wegner, Stellman, McCord, Wiles & Wood

[57] ABSTRACT

An indicating control structure for use in an appliance, such as a microwave oven, having a rotatably adjustable mechanism, such as the power level control thereof. The control includes a slider and a guide for guiding the slider reversibly along a preselected path. Integrally formed with the slider is a drive transmission for rotating the mechanism to a desired adjusted disposition as a result of a corresponding movement of the slider along the path. An indicator structure is associated integrally with the slider for indicating the disposition of the slider and, correspondingly, the adjusted disposition of the mechanism. The slider may define a flat plate with the guide slidably engaging the side edges of the plate to guide the slider in a substantially rectilinear path. The indicator structure may define an indicator and window which are selectively moved relative to a fixed adjacent indicium with the disposition of the window being displayed by a suitably associated illuminating device. The slider may be provided with a handle having opposed flat surfaces extending substantially perpendicular to the path of movement of the slider for facilitated control of the rotational disposition of the mechanism.

7 Claims, 5 Drawing Figures

FIG. 1
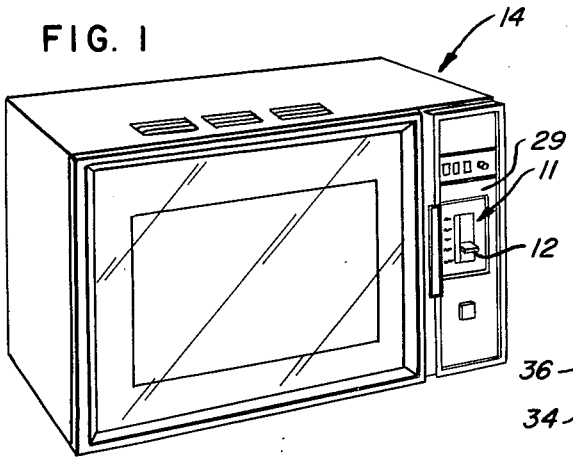
FIG. 2
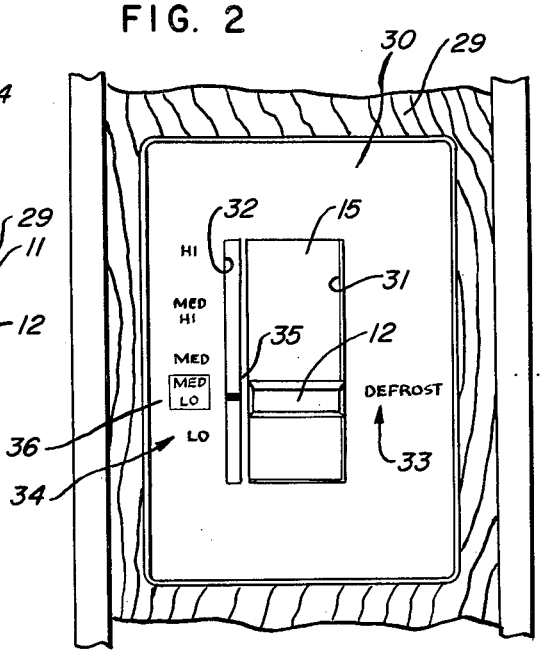
FIG. 5
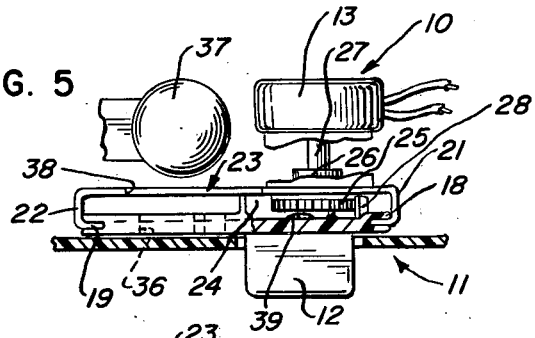
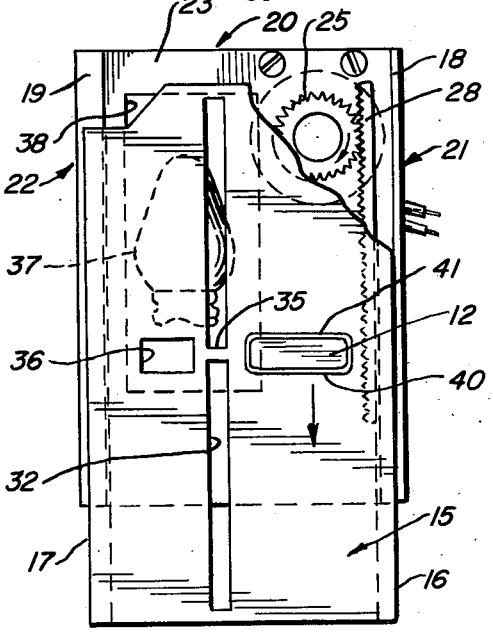
FIG. 3
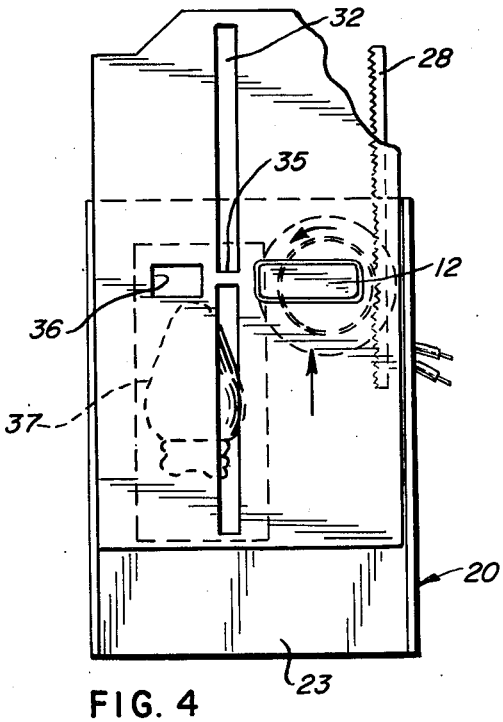
FIG. 4

INDICATING CONTROL STRUCTURE

BACKGROUND OF THE INVENTION

1. Field of the Invention

This invention relates to indicating controls and in particular to indicating controls for use in devices, such as microwave ovens, having rotatably adjustable mechanisms, such as the power level control means of such microwave ovens.

2. Description of the Prior Art

In U.S. Pat. No. 1,953,812 of George F. Lincks et al, a set of electric cut-outs are provided with fuse carriers having mounted thereto a pinion. A rack is provided for simultaneously actuating the pinions.

In U.S. Pat. No. 2,575,856 of Paul Ware, a spiral tuning device is shown for use with a television appliance, or the like, having a tuning shaft operating the tuning mechanism of the television receiver and carrying a translucent dial. On the face of the dial is provided a scale in the form of a seven-turn spiral and behind the dial is a small indicator lamp which is constrained to move along a vertical track by a sliding member having one edge in the form of a rack gear. Rotation of the shaft to adjust the television receiving mechanism rotates the scale correspondingly and causes a corresponding movement of the indicator lamp to eliminate the corresponding point on the scale spiral.

Albert E. Hedger, in U.S. Pat. No. 2,108,335, shows a radio tuning control having a manually adjustable knob connected to a rack having driving association with a pinion of the radio mechanism. Also connected to the knob is a flexible strip guided in an inclined guide to provide an indication of the disposition of the knob and correspondingly, the tuning control of the radio.

George C. Pearce, in U.S. Pat. No. 2,782,403, shows a slotted switch position indicator wherein a rotatable knob is connected to a cam which moves an indicator plate having a plurality of slots in a guided path adjacent a front plate having a different plurality of slots so that at any one time only an aligned pair of slots is illuminated by means of a rearwardly adjacent lamp. The rotatable mechanism is directly rotated by rotation of the knob so as to provide a desired correlation between the disposition of the control and the indicator.

Frank J. Skwarek, in U.S. Pat. No. 2,921,270, shows an extended frequency range signal generator control mechanism utilizing rack and pinion means as well as cam means in controlling a signal generator.

Walter L. Cherry et al disclose, in U.S. Pat. No. 3,499,127, a thumb wheel type switch utilizing rack and pinion means provided with a rotatable switch-carrying drum. An actuating lever extends to externally of the housing and a rotating means is rotated as a function of the movement of the actuating lever along a prescribed path.

Harold L. Purdy discloses, in U.S. Pat. No. 3,639,706, a reciprocating switch mechanism with improved thumb wheel actuator including a rack and pinion structure. A pair of gears are provided which are rotated to engage a stationary bar to move a carrier along the bar with the other gear moving the movable bar along the stationary bar a shorter distance than the carrier moves so as to move a slide a correspondingly shorter distance.

In U.S. Pat. No. 3,916,368, Herman D. Post et al show a positive motion fader device wherein a pair of potentiometers having rotary output shafts are mounted on a support. A first flexible steel strip is convoluted about a wheel associated with one of the potentiometers, and in reverse direction, about a wheel associated with the other of the potentiometers. A second similar strip is also convoluted in opposite directions about the wheels. A slider is connected with one of the strips and is guided in a slot so as to cause linear displacement of the strip elements in equal and opposite rotary movements of the wheels and output shafts of the potentiometers.

Junzo Tanaka et al, show in U.S. Pat. No. 3,978,305, a microwave oven control having signalling windows which are suitably illuminated by means of shutter mechanisms for controlling passage of light rays therefrom.

SUMMARY OF THE INVENTION

The present invention comprehends an improved control and indicator structure for use with a rotary mechanism, such as the power level control means of a microwave oven.

More specifically, the present invention comprehends such an improved control for concurrently rotating the rotatably adjustable mechanism of such an appliance and indicating the adjusted disposition of the mechanism. In the illustrated embodiment, the control includes a slider, means for guiding the slider reversibly along a preselected path, drive transmission means formed integrally with the slider for rotating the mechanism to a desired adjusted disposition as a result of a corresponding movement of the slider along the path, and indicator means formed integrally with the slider for indicating the disposition of the slider in the path and thus the adjusted disposition of the mechanism.

In the illustrated embodiment, the drive transmission means defines cooperating toothed means, such as rack and pinion means, providing a positive correlation between the dispositions of the slider and mechanism.

The guided path may be a rectilinear path, and in the illustrated embodiment, the slider comprises a flat plate having edge portions guided in the rectilinear path by means of a suitable associated guide.

In the illustrated embodiment, the indicator means includes means defining a window movable with the slider for selectively indicating indicia means fixedly disposed adjacent the slider.

The slider may be provided with a forwardly projecting handle, and in the illustrated embodiment, the handle defines a pair of opposed surfaces extending generally perpendicular to the direction of movement of the slider in the preselected path for facilitated control of the adjustment of the mechanism.

The slider plate, rack, and indicator window means may be formed as a one-piece molded synthetic resin element for effectively maximum economy and simplicity of construction.

Thus, the control of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view of a microwave oven having a control embodying the invention;

FIG. 2 is a fragmentary front elevation of the control as mounted in the microwave oven;

FIG. 3 is a fragmentary front elevation of the control with portions broken away to facilitate understanding of the invention;

FIG. 4 is a fragmentary front elevation of the control as arranged in a different adjusted disposition; and FIG. 5 is a fragmentary top plan view of the control.

DESCRIPTION OF THE PREFERRED EMBODIMENT

In the exemplary embodiment the invention as disclosed in the drawing, a rotary mechanism generally designated 10 is arranged to be rotated by a control generally designated 11 having a manually operable handle 12. In the illustrated embodiment, the rotary mechanism 10 comprises a power level control potentiometer 13 of a microwave oven generally designated 14. The potentiometer conventionally comprises one portion of the solid state power level control of such a microwave oven and is conventionally rotatably adjustable to provide a range of power output of the oven from approximately 0 to 100%. The present invention comprehends such a control wherein movement of the control handle 12 effects corresponding adjustment of the power level control potentiometer to effect accurate control of the power output of the oven over the entire range thereof.

The present invention is concerned with an improved simplified and low cost control means for effecting the desired rotative adjustment of the rotary mechanism 10 and concurrently indicating the adjusted disposition thereof. More specifically, control 11 includes a slider 15 which, in the illustrated embodiment, is defined by a flat plate having side edges 16 and 17. The side edges are slidably engaged with a pair of inturned slide guides 18 and 19, respectively, of a guiding means generally designated 20.

In the illustrated embodiment, guiding means 20 defines a metal channel member with the guides 18 and 19 comprising returned distal portions of U-shaped end flanges 21 and 22, respectively at opposite sides of the guide channel. Thus, as seen in FIG. 5, the slidable engagement of side edges 16 and 17 of the slider plate with the guides 18 and 19 spaces the slider plate forwardly of a rear bight portion 23 of the guiding means 20. Thus, side edges 16 and 17 guide the slider 15 in a preselected path as illustrated in FIG. 3.

Rotatably received in the space 24 between the plate 15 and guide wall 23 is a pinion 25 having a hub 26 splined to the shaft 27 of the rotary mechanism potentiometer 13. Hub 26 is rotatably journaled in the bight wall 23 and is rotated by a rack 28 formed integrally with the slider plate 15. As shown in FIG. 3, rack 28 has driving relationship with the pinion 25 so that as the plate 15 is moved upwardly and downwardly in the preselected vertical path defined by the guides 18 and 19, corresponding movement of the rack 28 effects a reversible selective adjustment of the rotary position of the pinion 25, and thus, the adjusted rotative position of the control means potentiometer 13. Thus, the drive transmission means defined by the rack 28, pinion 25, hub 26, and shaft 27 effectively rotate the potentiometer 13 to any desired adjusted position as a function of the adjustment of the slider in its preselected path.

As best seen in FIG. 1, control 11 is mounted behind a front wall portion 29 of the microwave oven provided with a flat decorative plate 30 having a first opening 31, a second opening 32, and indicia means 33 and 34 disposed adjacent the openings 31 and 32, respectively. Opening 31 has a preselected configuration permitting forward extension of the control handle 12 therethrough and permitting vertical movement of the control handle, and thus the slider plate 15, to cause rack 28 to rotate pinion 25 and thus potentiometer 13 over the entire rotatable range thereof.

Window 32 comprises a vertically elongate window having a divider 35 aligned with handle 12. Laterally of the divider 35, the slider plate 15 is further provided with a small rectangular opening 36 which selectively overlies different portions of the indicia means 34 to correspondingly display selectively portions of the indicia means 34 corresponding to the power level of operation of the oven resulting from the selected disposition of the handle 12. To effect such selective display, a lamp 37 is disposed rearwardly of an opening 38 in the guide wall bight 23. Decorative plate 30 is translucent so that as the window 36 is aligned with different portions of the indicia 34, the portions are displayed as illuminated by lamp 37 for facilitated observation by the microwave oven user.

In the illustrated embodiment, the divider 35 cooperates with the opening 32 to effectively define further indicating means, with the descriptive designation of the power level of the adjusted microwave oven being determinable by the alignment of divider 35 with the indicia 34. The indicium 33 may be disposed oppositely laterally of the control 11 and, thus, handle 12 serves synergistically as an indicating means relative to indicium 33.

In the illustrated embodiment, slider 15 and rack 28 are formed as a one-piece molded synthetic resin element with the indicator divider 35 and window 36 being formed integrally therewith. Handle 12 may be secured to the slider plate by suitable means, such as screw 39. Handle 12 may define a lower flat surface 40 and an upper flat surface 41 extending generally perpendicular to the longitudinal extent of the guides 18 and 19, and therefore, the direction of movement of the slider plate 15 in the vertically guided path.

In the illustrated embodiment, the rack has a length of approximately 3 inches with the gear ratio thereof being preselected so that approximately 2 inches of rack travel effects substantially 300° arcuate rotation of the control potentiometer. In the illustrated embodiment, the decorative plate 30 is formed of glass. The portion of the glass plate 30 overlying the opening 32 may have variable coloring so that the divider 35 may designate a portion of the viewable colored, vertically elongated rectangle to further facilitate reading the control setting by the user. In the illustrated embodiment, the coloring changes from a yellow in the lower portion of the viewable area to a red in the upper portion.

Thus, the control of the present invention may be seen to be extremely simple and economical of construction while yet providing highly accurate adjustment of the power level of the oven and correspondingly accurate indication of the power level setting effected by the control.

The foregoing disclosure of specific embodiments is illustrative of the broad inventive concepts comprehended by the invention.

The embodiments of the invention in which an exclusive property or privilege is claimed are defined as follows:

1. In a control structure for concurrently rotating a rotatably adjustable mechanism and indicating the adjusted disposition of the mechanism, including a slider having a manipulating handle, means for guiding the slider reversibly along a preselected path in said control structure, and drive transmission means for rotating the mechanism to a desired adjusted disposition as a result of a corresponding movement of the slider along said path, the improvement comprising indicator means for indicating the disposition of said slider in said path and resultingly the adjusted disposition of the mechanism including means defining an integrally formed window movable with said slider and indicia means disposed adjacent said path to be selectively exposed by said window for indicating said disposition.

2. The control structure of claim 1 wherein said indicator means further includes means for illuminating the indicia means exposed by said window.

3. The control structure of claim 1 wherein said slider comprises a one-piece, molded synthetic resin element.

4. The control structure of claim 1 wherein said guiding means comprises a channel member having edge portions slidably mounting said slider.

5. The control structure of claim 1 wherein a second indicia means is disposed adjacent said handle for further indicating said disposition.

6. The control structure of claim 1 wherein said indicator means includes a plurality of different indicators movable with said slider.

7. The control structure of claim 1 wherein said indicator means includes a plurality of different indicators movable with said slider and cooperating with said indicia means for cumulatively indicating said disposition.

* * * * *